US011736844B2

(12) United States Patent
Chien et al.

(10) Patent No.: US 11,736,844 B2
(45) Date of Patent: Aug. 22, 2023

(54) EARPHONE MODULE

(71) Applicant: Merry Electronics Co., Ltd., Taichung (TW)

(72) Inventors: Jui-Hsien Chien, Taichung (TW); Wan-Hsuan Weng, Taichung (TW); Ying-Ying Peng, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 76 days.

(21) Appl. No.: 17/671,617

(22) Filed: Feb. 15, 2022

(65) Prior Publication Data

US 2023/0232142 A1 Jul. 20, 2023

(30) Foreign Application Priority Data

Jan. 18, 2022 (TW) ..... 111102049

(51) Int. Cl.

| | |
|---|---|
| ***H04R 1/10*** | (2006.01) |
| ***H04R 1/04*** | (2006.01) |
| ***H01Q 1/24*** | (2006.01) |
| *H01Q 9/04* | (2006.01) |

(52) U.S. Cl.

CPC ..... *H04R 1/04* (2013.01); *H01Q 1/241* (2013.01); *H04R 1/1016* (2013.01); *H04R 1/1041* (2013.01); *H01Q 9/0421* (2013.01)

(58) Field of Classification Search

CPC ..... H04R 1/04; H04R 1/1016; H04R 1/1041; H01Q 1/241

See application file for complete search history.

(56) References Cited

U.S. PATENT DOCUMENTS

| | | | | |
|---|---|---|---|---|
| 2015/0270619 | A1* | 9/2015 | Zhu | H01Q 1/2266 343/702 |
| 2018/0069588 | A1* | 3/2018 | Jiang | H04B 1/40 |
| 2022/0276682 | A1* | 9/2022 | Yu | H01Q 9/045 |

* cited by examiner

*Primary Examiner* — Simon King
(74) *Attorney, Agent, or Firm* — JCIPRNET

(57) ABSTRACT

An earphone module includes a first circuit board. The first circuit board includes a touch panel layer, a grounding layer, an antenna layer and a touch circuit layer assembly. The grounding layer is disposed apart from and below the touch panel layer. The antenna layer includes an antenna flat portion, an antenna feed wire and an antenna short-circuit wire. The antenna flat portion is disposed apart from and below the grounding layer, and the antenna feed wire and the antenna short-circuit wire are connected to the antenna flat portion. The touch circuit layer assembly is disposed apart from and below the antenna flat portion and includes a touch chip. The touch panel layer is electrically connected to the touch chip.

13 Claims, 10 Drawing Sheets

EARPHONE MODULE

CROSS-REFERENCE TO RELATED APPLICATION

This application claims the priority benefit of Taiwan application serial no. 111102049, filed on Jan. 18, 2022. The entirety of the above-mentioned patent application is hereby incorporated by reference herein and made a part of this specification.

BACKGROUND

Technology Field

The disclosure relates to an earphone module, and more particularly, to an earphone module integrating touch and antenna functions.

Description of Related Art

Generally, in wireless earphones with touch function, some elastic elements are adopted to connect between an antenna and a circuit board, and other elastic elements are also adopted to connect between a touch panel and the circuit board. Due to the large volume of the elastic elements and the requirement of a certain quantity, the elastic elements take up a large space inside the earphone, which is unfavorable for space utilization and improvement of earphone performance.

SUMMARY

The disclosure provides an earphone module, which integrates touch and antenna structures by elements in a stacked multi-layer manner without adopting elastic elements to connect between an antenna and a circuit board or between a touch panel and the circuit board, which not only saves the internal space of the earphone but also brings good antenna performance.

An earphone module of the disclosure includes a first circuit board. The first circuit board includes a touch panel layer, a grounding layer, an antenna layer, and a touch circuit layer assembly. The grounding layer is disposed apart from and below the touch panel layer. The antenna layer includes an antenna flat portion, an antenna feed wire, and an antenna short-circuit wire. The antenna flat portion is disposed apart from and below the grounding layer, and the antenna feed wire and the antenna short-circuit wire are connected to the antenna flat portion. The touch circuit layer assembly is disposed apart from and below the antenna flat portion and includes a touch chip. The touch panel layer is electrically connected to the touch chip.

In an embodiment of the disclosure, the touch circuit layer assembly further includes a touch wire assembly disposed apart from and below the antenna short-circuit wire, and a width of the antenna short-circuit wire is greater than or equal to a width of the touch wire assembly.

In an embodiment of the disclosure, the touch circuit layer assembly further includes a ground wire located beside the touch wire assembly, and the ground wire is located between the touch wire assembly and a projection of the antenna feed wire on a surface where the touch wire assembly is located.

In an embodiment of the disclosure, the touch circuit layer assembly further includes a first touch circuit layer, a second touch circuit layer, and a third touch circuit layer. The first touch circuit layer is disposed apart from and below the antenna flat portion; the second touch circuit layer is disposed apart from and below the first touch circuit layer; the third touch circuit layer is disposed apart from and below the second touch circuit layer; and the touch chip is located on the third touch circuit layer.

In an embodiment of the disclosure, the antenna flat portion, the first touch circuit layer, the second touch circuit layer, and the third touch circuit layer are connected to the grounding layer through multiple ground through holes.

In an embodiment of the disclosure, the touch panel layer is connected to the touch circuit layer assembly through the grounding layer and multiple touch through holes on the antenna flat portion and electrically connected to the touch chip.

In an embodiment of the disclosure, the touch panel layer includes multiple blocks electrically separated from each other, and the blocks are connected to the touch circuit layer assembly through the touch through holes, respectively.

In an embodiment of the disclosure, the earphone module further includes a microphone. The first circuit board includes a notch corresponding to the microphone, and a projection of the microphone on the first circuit board is located within the notch.

In an embodiment of the disclosure, the earphone module further includes a second circuit board disposed below the first circuit board. A resonance path is the antenna feed wire from the second circuit board along an edge of the first circuit board to a portion beside the notch, the resonance path is coupled out a frequency band, and the length of the resonance path is 0.25 times a wavelength of the frequency band.

In an embodiment of the disclosure, when the earphone module is placed in a human ear, the antenna feed wire is close to an inferior crus of the antihelix of the human ear and away from an earlobe, and the resonance path extends along a direction of a tragus and an antitragus from the inferior crus of the antihelix.

In an embodiment of the disclosure, the earphone module further includes a second circuit board disposed below the first circuit board. The antenna feed wire and the antenna short-circuit wire are connected to the second circuit board, and a shortest distance between the first circuit board and the second circuit board is greater than or equal to 2.5 mm.

In an embodiment of the disclosure, the earphone module further includes a second circuit board disposed below the first circuit board. The first circuit board includes a first side and a second side opposite to each other, the second circuit board includes a third side and a fourth side opposite to each other, the antenna feed wire is disposed on the first side of the first circuit board and the third side of the second circuit board, and a distance between the second side and the fourth side is greater than or equal to a distance between the first side and the third side.

In an embodiment of the disclosure, when the earphone module is placed in a human ear, the second circuit board is located between the first circuit board and an external auditory canal of the human ear, so that the antenna layer generates an antenna polarization direction that enters the external auditory canal.

In summary, the first circuit board of the earphone module of the disclosure includes a touch panel layer, a grounding layer, an antenna layer, and a touch circuit layer assembly. The grounding layer is disposed apart from and below the touch panel layer. The antenna layer includes an antenna flat portion, an antenna feed wire, and an antenna short-circuit wire. The antenna flat portion is disposed apart from and below the grounding layer, and the antenna feed wire and the antenna short-circuit wire are connected to the antenna flat portion. The touch circuit layer assembly is disposed apart from and below the antenna flat portion and includes a touch chip. The touch panel layer is electrically connected to the touch chip. With the multi-layer integration design, the earphone module of the disclosure integrates the touch and antenna structure on the first circuit board, which not only saves the internal space of the earphone but also brings good antenna performance.

DESCRIPTION OF THE EMBODIMENTS

Figure 1:
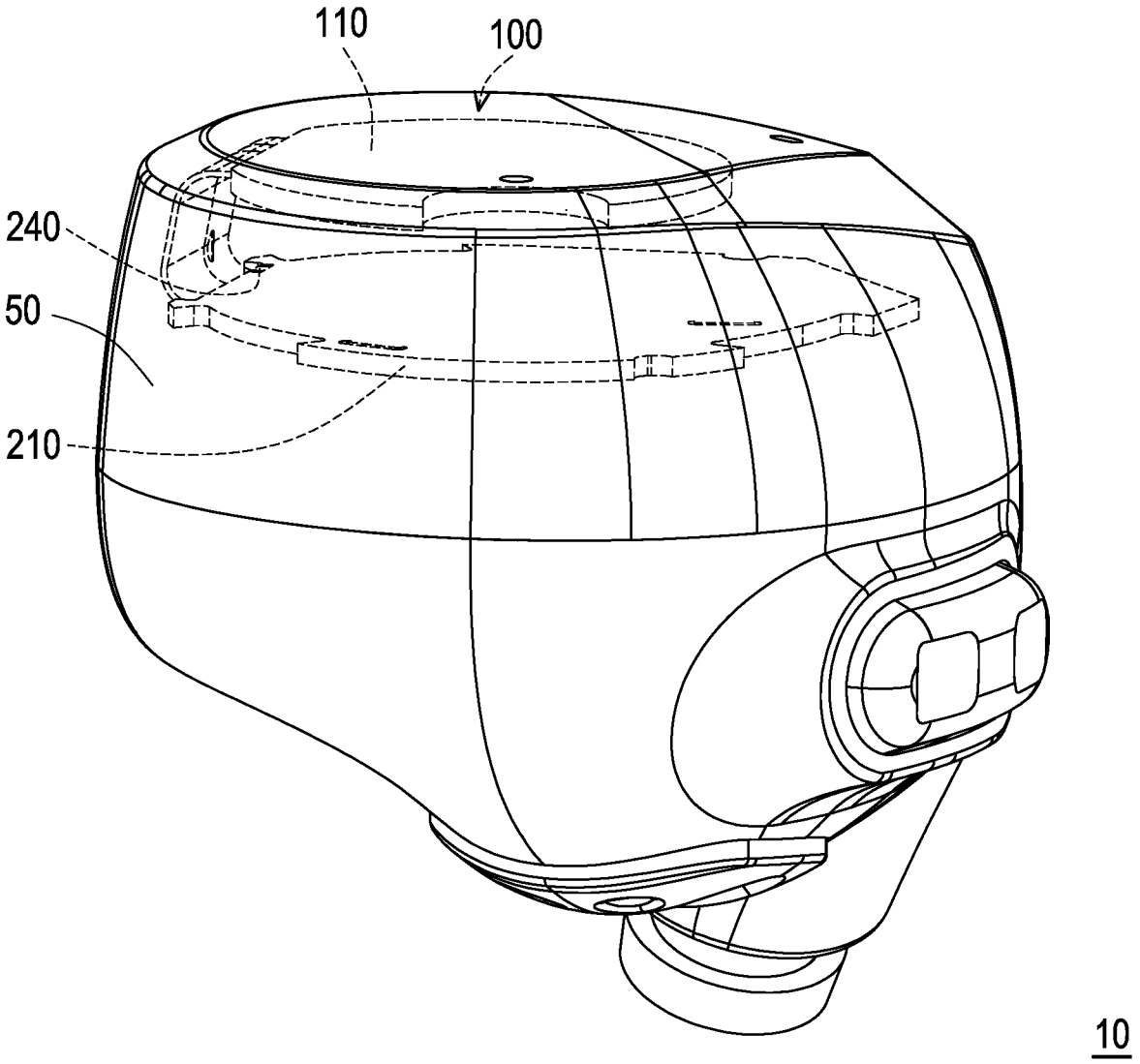
FIG. 1 is a schematic view of an outlook of an earphone module according to an embodiment of the disclosure.
Figure 2:
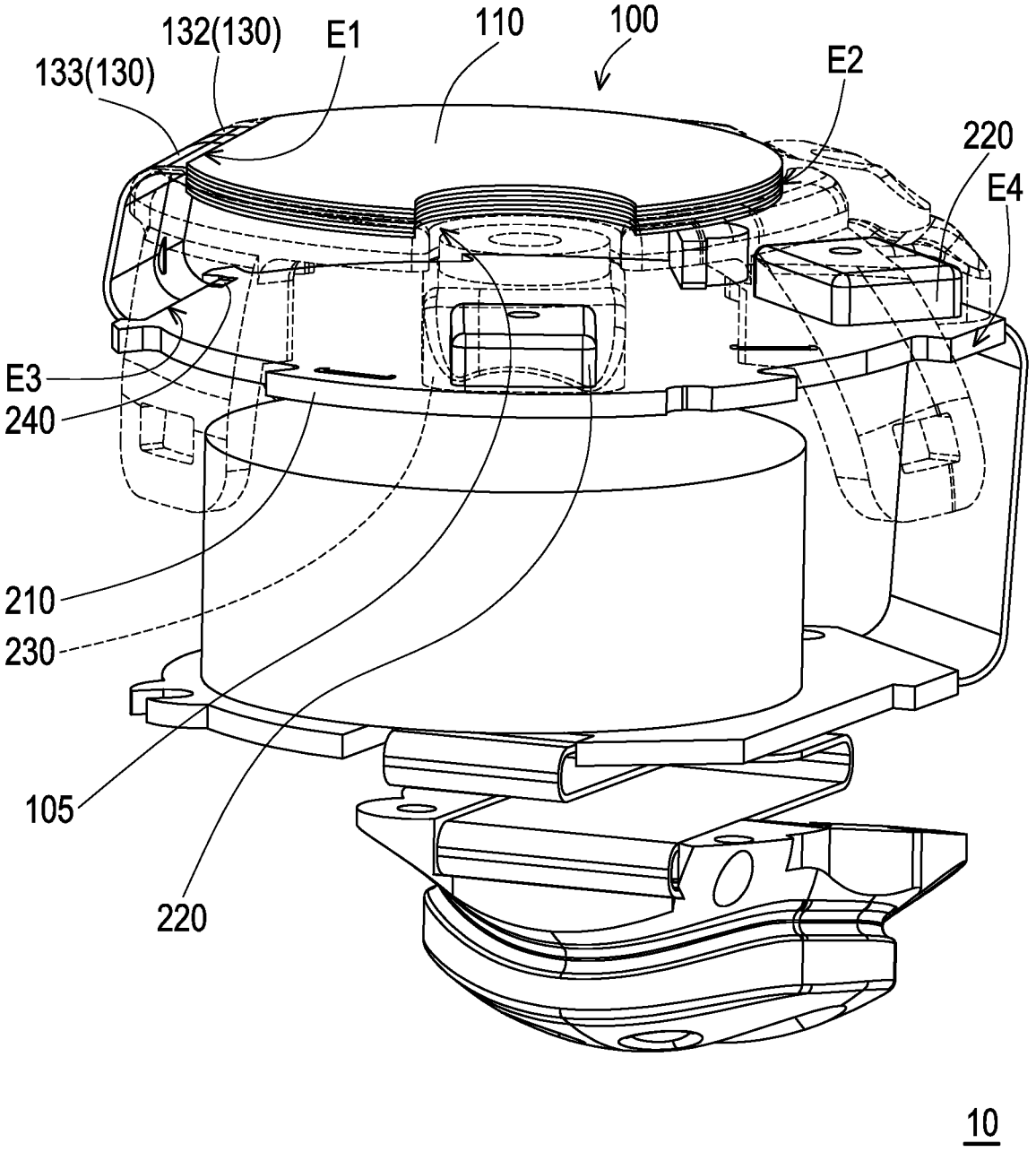
FIG. 2 is a schematic view of a hidden casing of the earphone module of FIG. 1.

FIG. 1 is a schematic view of an outlook of an earphone module according to an embodiment of the disclosure. FIG. 2 is a schematic view of a hidden casing of the earphone module of FIG. 1. Note that in FIG. 2, to clearly present the internal structure of the earphone module, a casing 50 of the earphone is hidden.

Referring to FIG. 1 and FIG. 2, an earphone module 10 of the embodiment includes the casing 50 and a first circuit board 100, a second circuit board 210 and at least one microphone 220 (shown in FIG. 2) disposed in the casing 50, and a plastic part 230 (shown by dashed lines in FIG. 2).

In the embodiment, the second circuit board 210 is disposed below the first circuit board 100, and the plastic part 230 (shown in FIG. 2) is disposed between the first circuit board 100 and the second circuit board 210 to support the first circuit board 100. The material of the plastic part 230 is not limited to plastic but can also be other non-conductive materials.

In the embodiment, the earphone module 10 integrates the touch function and the antenna structure on the first circuit board 100 by means of multi-layer integration, and the first circuit board 100 is electrically connected to the second circuit board 210 (a motherboard) through flexible printed circuit. The first circuit board 100 is to be illustrated in the subsequent paragraphs.

Figure 3:
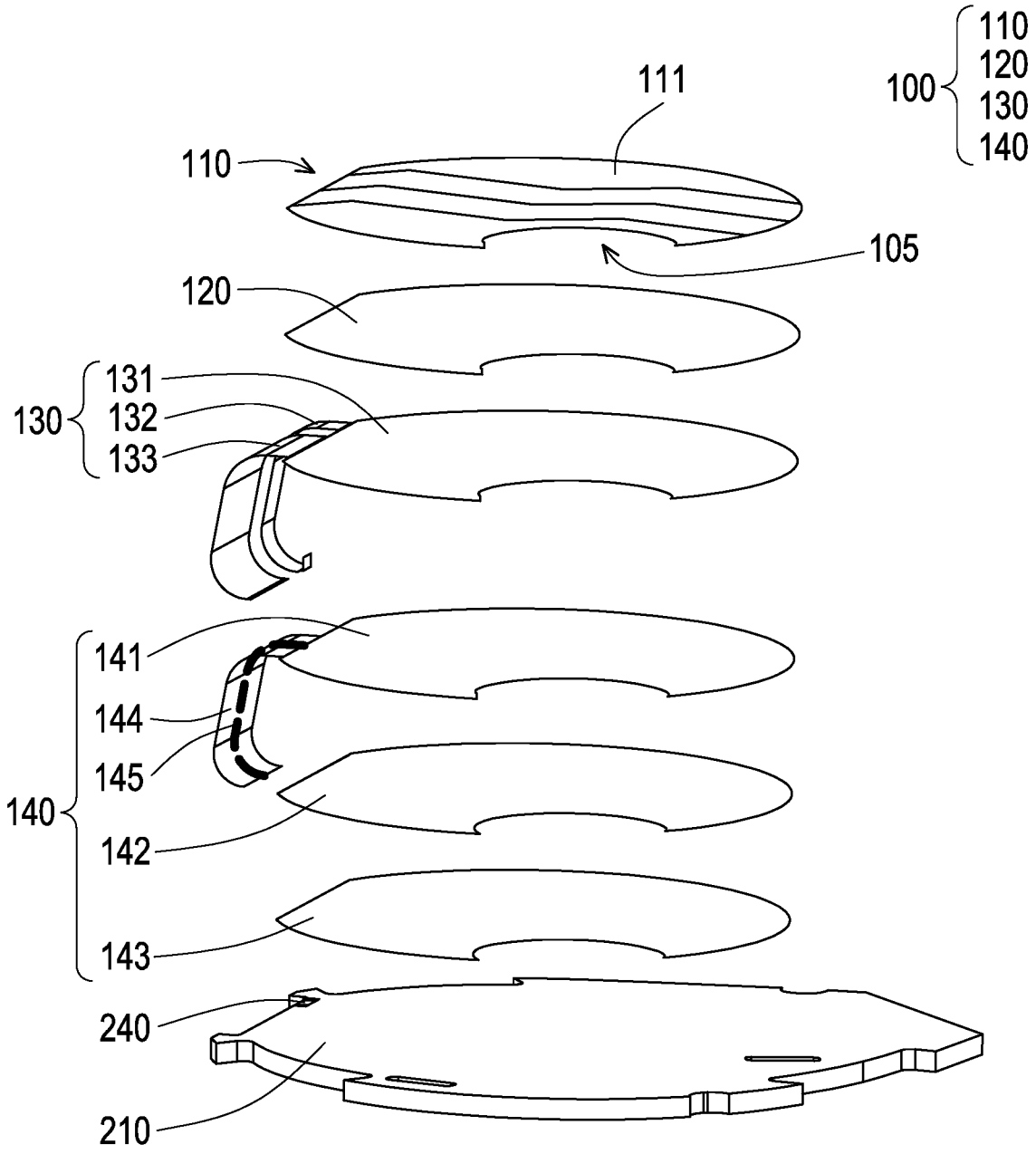
FIG. 3 is an exploded view of a multilayer structure of a first circuit board of the earphone module of FIG. 1 and a schematic view of the second circuit board of FIG. 1.

FIG. 3 is an exploded view of a multilayer structure of the first circuit board of the earphone module of FIG. 1 and a schematic view of the second circuit board of FIG. 1. Note that, in FIG. 3, multiple dielectric layers between these circuit layers are hidden, and actually these circuit layers are separated from each other.

Referring to FIG. 3, in the embodiment, the first circuit board 100 includes a touch panel layer 110, a grounding layer 120, an antenna layer 130, and a touch circuit layer assembly 140.

The touch panel layer 110 includes multiple blocks 111 that are electrically separated from each other, thereby sensing different touch gestures of the user and further implementing the multi-touch function. The number of the blocks 111 in the embodiment is four, but the disclosure is not limited thereto. The number of the blocks 111 may be adjusted according to design requirements.

The grounding layer 120 is disposed apart from and below the touch panel layer 110 and electrically isolates the touch panel layer 110 from the antenna layer 130, so that the first circuit board 100 can be compatible with touch and antenna signals.

The antenna layer 130 is disposed apart from and below the grounding layer 120 and includes an antenna flat portion 131, an antenna feed wire 132, and an antenna short-circuit wire 133. The antenna layer 130 is a planar inverted-F antenna structure (PIFA). The outline and the shape of the antenna flat portion 131 substantially correspond to the outline and the shape of the touch panel layer 110 and the grounding layer 120. The antenna feed wire 132 and the antenna short-circuit wire 133 are separated from each other and connected to the antenna flat portion 131.

In the embodiment, the antenna flat portion 131 is connected to an antenna feed point 240 of the second circuit board 210 through the antenna feed wire 132, so that the radio frequency signal of the second circuit board 210 can be transmitted to the antenna flat portion 131. The earphone module 10 of the embodiment requires no use of elastic elements to connect between the antenna and the circuit board as in the conventional structure. Instead, the antenna layer is connected to the second circuit board 210 through the antenna feed wire 132, and therefore the volume can be effectively reduced and a more stable antenna signal can be provided.

In addition, the antenna short-circuit wire 133 is connected to the second circuit board 210 to serve as the reference ground of the touch circuit layer assembly 140 to prevent high frequency interference that may be generated by the touch circuit layer assembly 140.

The touch circuit layer assembly 140 is disposed apart from and below the antenna flat portion 131. The touch circuit layer assembly 140 includes a first touch circuit layer 141, a second touch circuit layer 142, and a third touch circuit layer 143. As shown in FIG. 3, the first touch circuit layer 141 is disposed apart from and below the antenna flat portion 131, the second touch circuit layer 142 is disposed apart from and below the first touch circuit layers 141, and the third touch circuit layer 143 is disposed apart from and below the second touch circuit layer 142.

The first touch circuit layer 141, the second touch circuit layer 142, and the third touch circuit layer 143 are all part of the touch circuit layout. Specifically, the first touch circuit layer 141 may have touch power wires (not shown) and control signal wires (not shown) on the plane.

In addition, the first touch circuit layer 141 further includes a touch wire assembly 144 extending downward. The touch wire assembly 144 is disposed apart from and below the antenna short-circuit wire 133. In the embodiment, the width of the antenna short-circuit wire 133 is greater than or equal to the width of the touch wire assembly 144, so that the antenna short-circuit wire 133 can provide a favorable anti-interference effect. The width of the antenna short-circuit wire 133 and the width of the touch wire assembly 144 can be adjusted according to requirements, and the disclosure is not limited thereto.

In addition, the second touch circuit layer 142 includes a touch power wire (not shown), a control signal wire (not shown), a touch circuit reference ground wire (not shown) and a voltage regulator circuit reference ground wire (not shown). Furthermore, the third touch circuit layer 143 includes a touch chip 150 (shown in FIG. 4F) and a voltage regulator circuit (not shown). The touch chip 150 is used for processing touch signals of the touch panel layer 110.

In addition, in the embodiment, the touch chip 150 can bridge the power wires (not shown) and control signal wires (not shown) of the Bluetooth microcontroller unit (not shown) of the second circuit board 210 through the touch wire assembly 144 of the first touch circuit layer 141.

FIG. 4A to FIG. 4F are schematic views each illustrating the layout of the touch panel layer, the layout of the grounding layer, the layout of the antenna layer, the layout of the first touch circuit layer, the layout of the second touch circuit layer, and the layout of the third touch circuit of the first circuit board 100 of the earphone module of FIG. 1.

Referring to FIG. 4A to FIG. 4F, the blocks 111 of the touch panel layer 110, the antenna flat portion 131, the first touch circuit layer 141, the second touch circuit layer 142, and the third touch circuit layer 143 can be electrically connected to the grounding layer 120 through multiple grounding through holes H1 on the periphery of each layer to implement the effect of system common ground.

In addition, the blocks 111 of the touch panel layer 110 are connected to the third touch circuit layer 143 through multiple touch through holes H2 (shown in FIG. 4B to FIG. 4E) of the grounding layer 120, the antenna flat portion 131, the first touch circuit layer 141, and the second touch circuit layer 142.

Therefore, the touch panel layer 110 can be electrically connected to the touch chip 150 of the third touch circuit layer 143. In other words, the capacitance change signal of the touch panel layer 110 caused by the finger touch of the user can be transmitted to the touch chip 150 through the touch through holes H2, and the touch chip 150 can process the received touch signals to determine the gesture change of the user, thereby implementing the multi-touch function.

In the conventional earphone module, elastic elements are adopted to connect between the touch panel and the circuit board, and other elastic elements are also adopted to connect between the antenna and the circuit board. Due to the large volume of the elastic elements, not only a lot of space inside the earphone are taken up, but also the function of multi-touch is difficult to implement since it is difficult to increase the quantity of the elastic elements due to the limited space.

Compared with the conventional earphone module, the earphone module 10 of the embodiment requires no use of the elastic elements to connect between the antenna and the circuit board or between the touch panel and the circuit board. Instead, the multilayer integrated first circuit board 100 is adopted, and the touch panel layer 110 is directly connected to the third touch circuit layer 143 where the touch chip 150 is located through the touch through holes H2, which greatly shortens the distance therebetween and saves the internal space taken up by the elastic elements.

In addition, in the embodiment, with the design of the earphone module 10 without disposing multiple elastic elements but adopting multiple touch through holes H2 corresponding to the blocks 111, the function of multi-touch can be implemented under a limited volume. Besides, since the distance between the touch panel layer 110 and the touch chip 150 is shortened, the error of the touch signal is effectively reduced. In the embodiment, the quantity of the ground through holes H1 and the quantity of the touch through holes H2 can be increased or decreased according to design requirements.

Figure 4B:
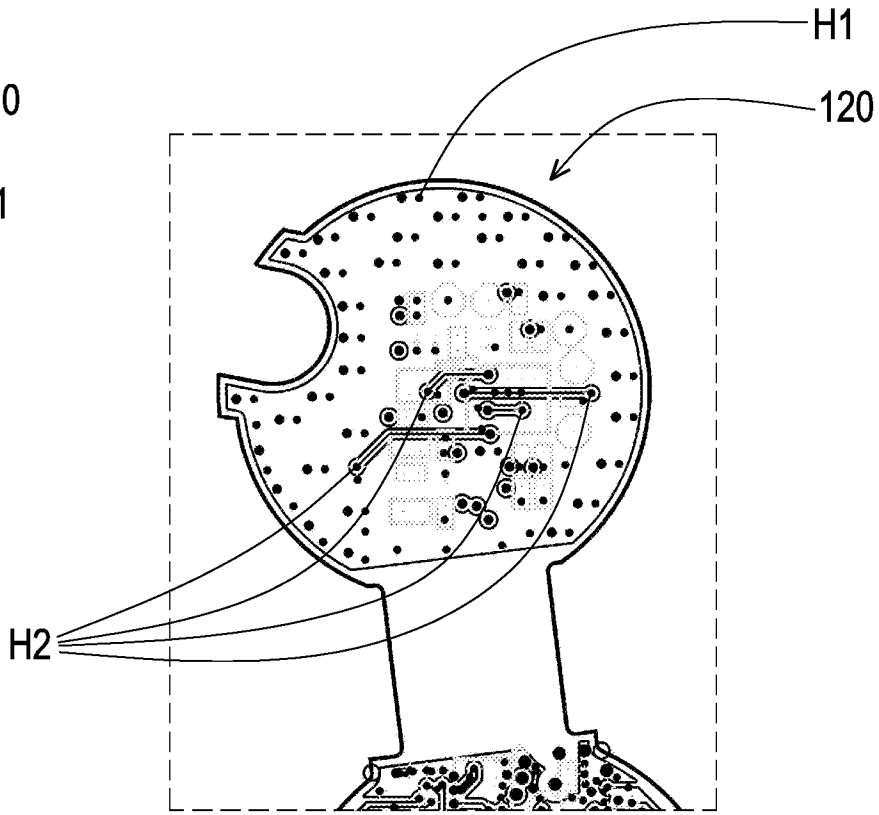
FIG. 4B is a schematic view of a layout of a grounding layer of the earphone module of FIG. 1.
Figure 4A:
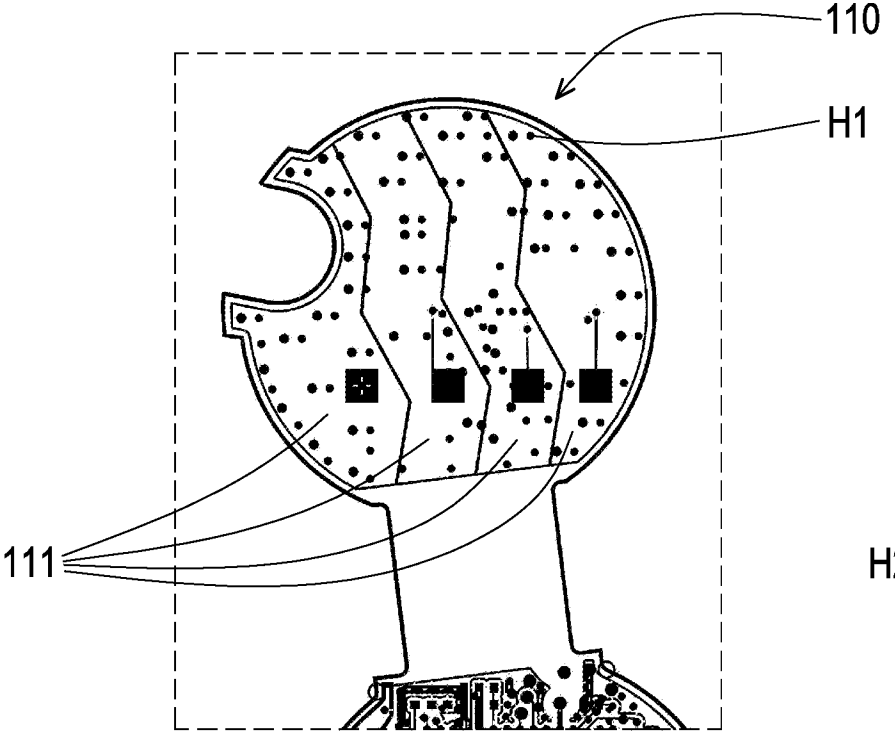
FIG. 4A is a schematic view of a layout of a touch panel layer of the earphone module of FIG. 1.
Figure 4D:
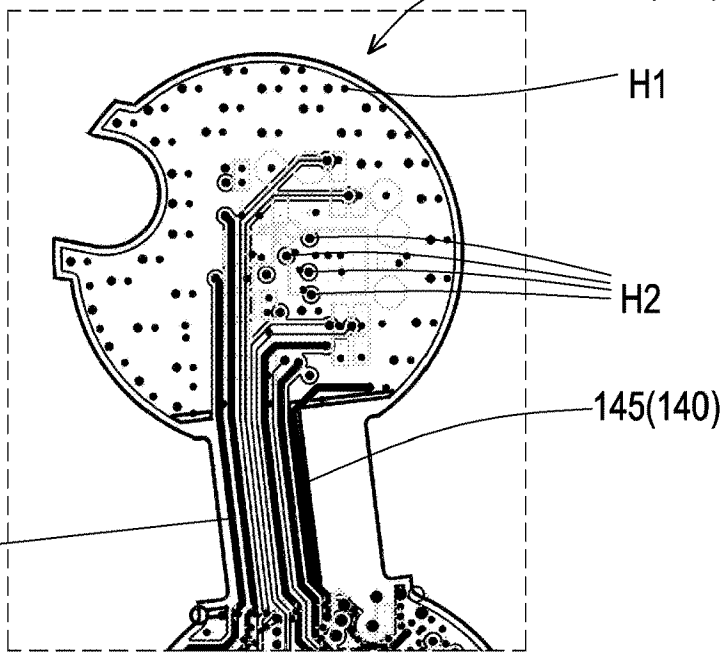
FIG. 4D is a schematic view of a layout of a first touch circuit layer of the earphone module of FIG. 1.
Figure 4C:
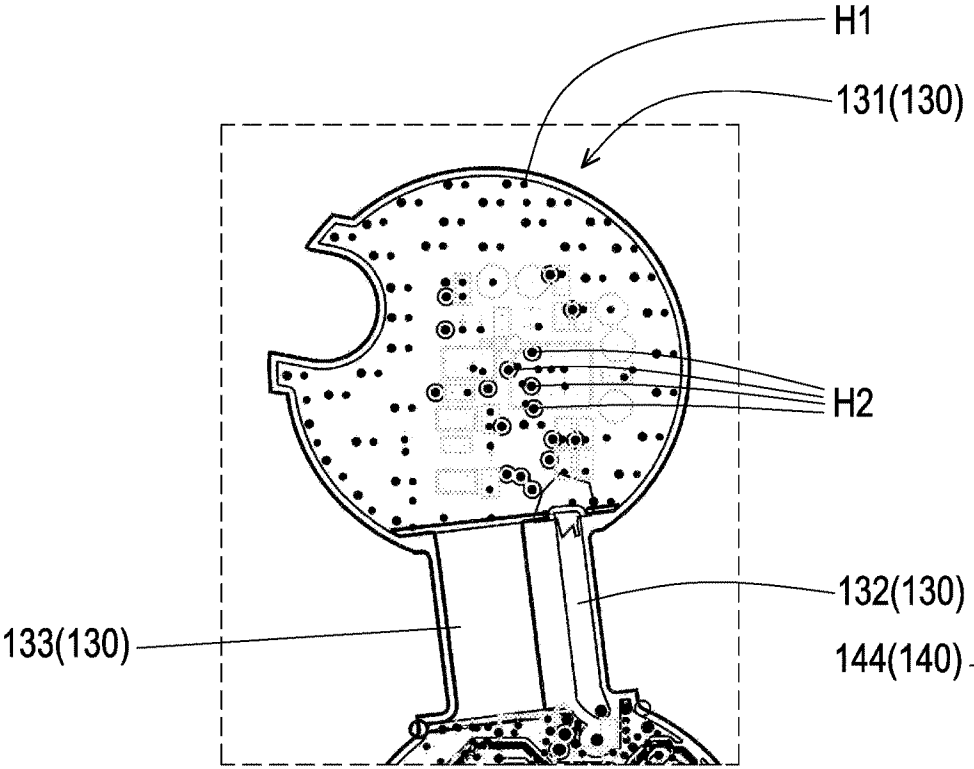
FIG. 4C is a schematic view of a layout of an antenna layer of the earphone module of FIG. 1.
Figure 4F:
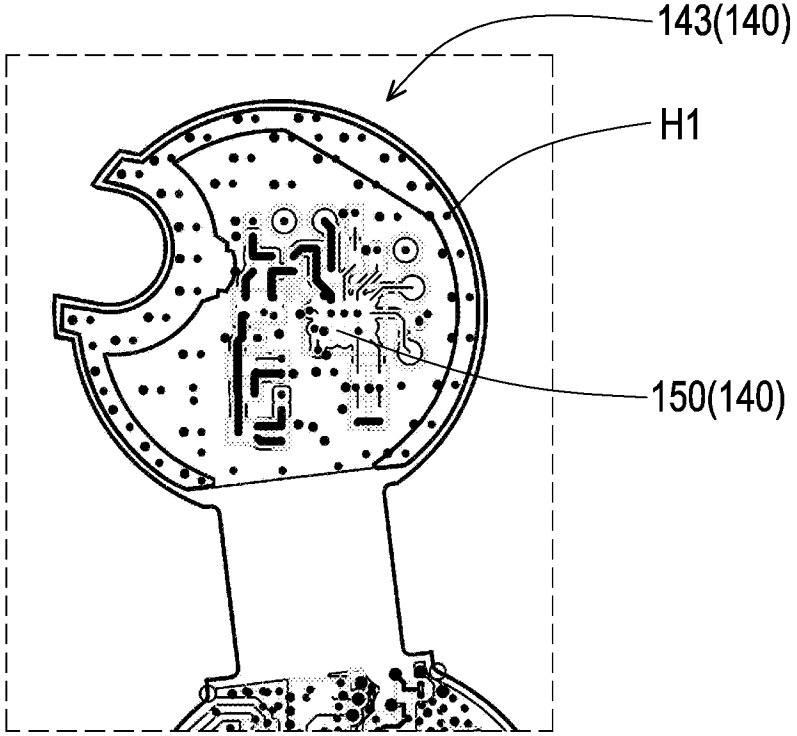
FIG. 4F is a schematic view of a layout of a third touch circuit layer of the earphone module of FIG. 1.
Figure 4E:
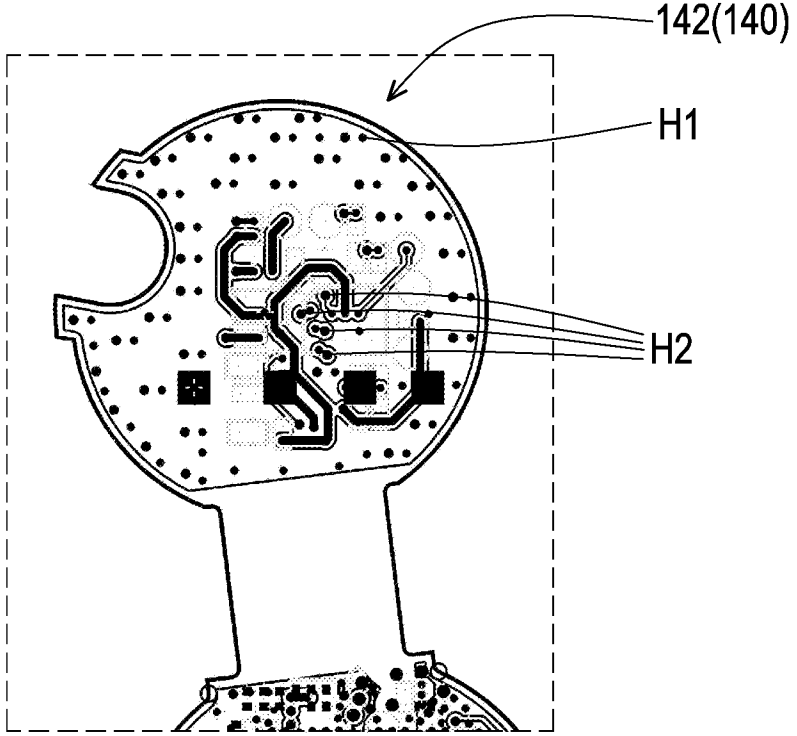
FIG. 4E is a schematic view of a layout of a second touch circuit layer of the earphone module of FIG. 1.

Note that as shown in FIG. 4C and FIG. 4D, a ground wire 145 of the first touch circuit layer 141 is located beside the touch wire assembly 144 and between the touch wire assembly 144 and the projection of the antenna feed wire 132 on the surface where the touch wire assembly 144 is located. With such a design, the ground wire 145 can effectively separate the antenna signal and the touch signal to prevent mutual interference therebetween.

Figure 5:
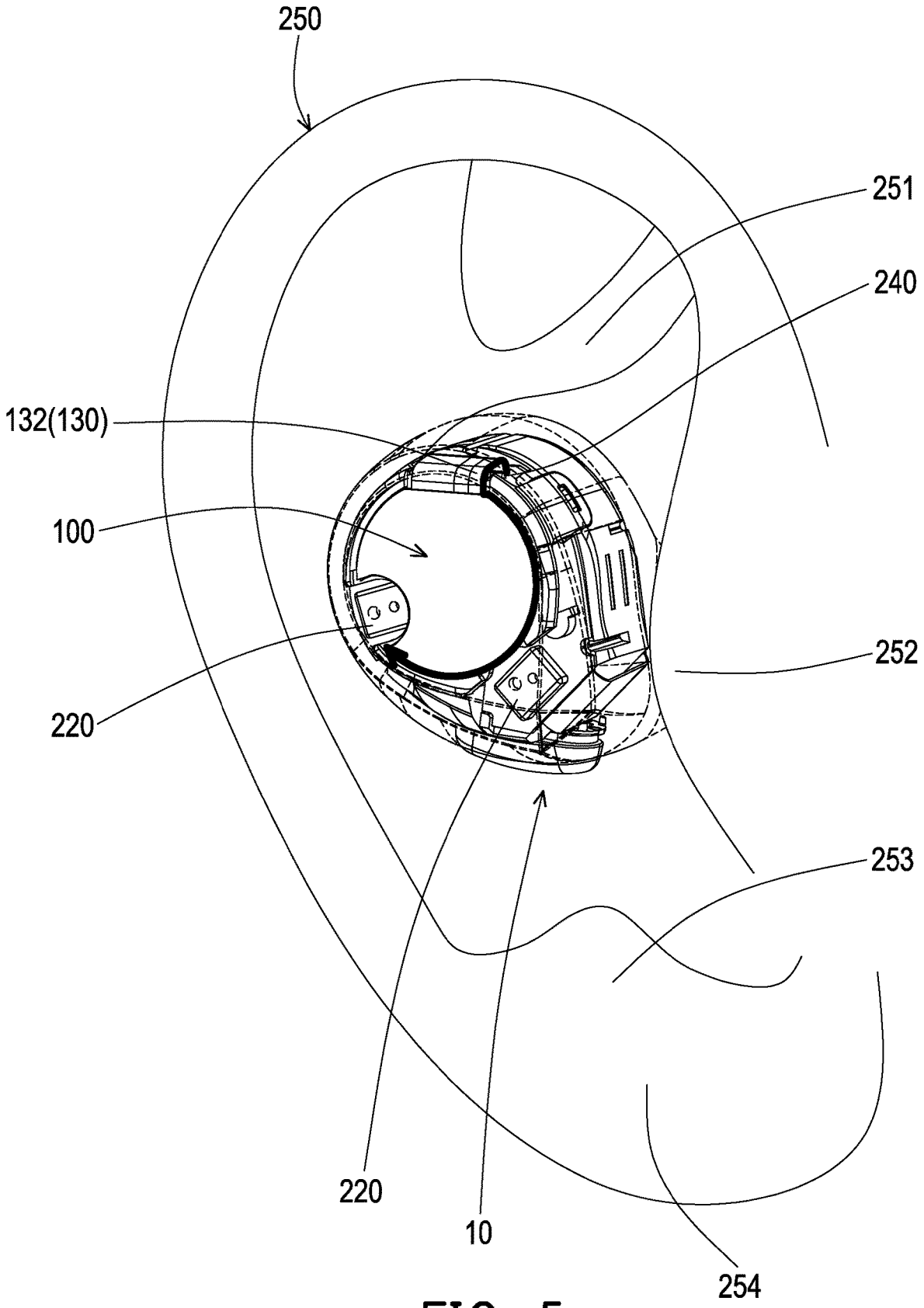
FIG. 5 is a schematic view of the earphone module of FIG. 1 put into a human ear.

FIG. 5 is a schematic view of the earphone module of FIG. 1 being put into a human ear. Note that to clearly present the positions of the internal components, the casing of the earphone module 10 is shown in perspective. As shown in FIG. 5, a human ear 250 includes an inferior crus of antihelix 251 located above the ear canal hole (where the earphone module 10 is inserted, not shown), a tragus 252 located on the right side of the ear canal hole, an antitragus 253 located below the ear canal hole, and an earlobe 254 located in the lower part of the human ear.

When in use, the earphone module 10 may form a Bluetooth connection with an electronic device (not shown), such as a mobile phone or a tablet computer, so taking a mobile phone as an example, the mobile phone may be placed in a pocket or held by the user, and meanwhile the Bluetooth connection between the earphone module 10 and the electronic device may be blocked by the human body. As shown in FIG. 5, in the embodiment, when the earphone module 10 is placed in the human ear 250, the antenna feed wire 132 may be close to the inferior crus of antihelix 251 of the human ear 250 and away from the earlobe 254, so that the antenna radiates toward the lower right part of FIG. 5 (i.e., toward the direction of the electronic device). Such a design can bring good cross-body performance for the Bluetooth connection between the earphone module 10 and the electronic device when in use.

The antenna resonance path (the thick black arrow line in the center of the earphone module 10 in FIG. 5) of the embodiment starts from the antenna feed point 240 (shown in FIG. 2) near the inferior crus of antihelix 251, goes along the antenna feed wire 132, gradually moves away from the ear canal hole, then extends in the direction of the antitragus 253 along the periphery of the first circuit board 100 close to the tragus 252, and finally goes to the position beside a notch 105 (as shown in FIG. 2) of the first circuit board 100.

Referring to FIG. 2 and FIG. 5, the plastic part 230 (dielectric constant $\varepsilon_r$=2.7) and air ($\varepsilon_r$=1) are used as the medium between the first circuit board 100 and the second circuit board 210. Under such conditions, the length of the antenna resonance path is 26.8 mm, and it can couple out 0.25 times the wavelength of a frequency band. The frequency band coupled out by the earphone module 10 is the 2.4 GHz Bluetooth frequency band, for example, but the frequency band is not limited thereto. In addition, the earphone module 10 has a matching impedance circuit, and after the whole machine is assembled, the radiation efficiency of the antenna can be properly optimized.

In addition, in the embodiment, the number of the at least one microphone 220 is two and disposed on the second circuit board 210 (as shown in FIG. 2). The position of the microphone 220 is determined according to the optimal simulation result of the microphone algorithm. The connection between the two microphones 220 generally faces the mouth (not shown and located at the lower right part of FIG. 5) of the user, which contributes to the antenna performance in sending and receiving signals, but the position is not limited thereto.

In addition, to allow the connection between the two microphones 220 to generally face the mouth of the user, the first circuit board 100 includes the notch 105 corresponding to the microphone 220, so that the projection of the microphone 220 on the first circuit board 100 is located within the notch 105. Such a design allows the first circuit board 100 to avoid the microphone 220, so that the spatial arrangement of the microphone 220 is more flexible.

In the embodiment, the second circuit board 210 (as shown in FIG. 2) is located below the first circuit board 100, so when the earphone module 10 is placed in the human ear 250, the second circuit board 210 may be located between the first circuit board 100 and the external auditory canal (not shown, at the hole in the auditory canal) of the human ear 250, which contributes to the generation of the polarization direction of the antenna entering the external auditory canal by the antenna layer 130, so as to reduce the influence of the human body on the antenna performance.

Figure 6A:
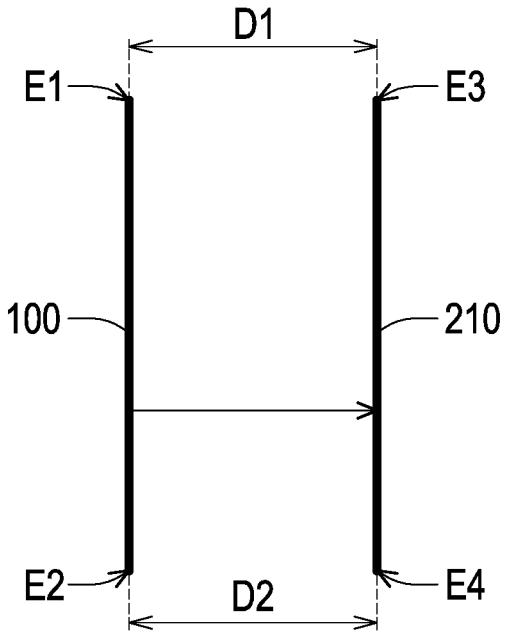
FIG. 6A is a schematic view illustrating one kind of the relative positions of the first circuit board and the second circuit board of the earphone module of FIG. 1.

FIG. 6A is a schematic view illustrating the relative positions of the first circuit board and the second circuit board of the earphone module of FIG. 1. Referring to FIG. 6A, the second circuit board 210 is located on the right side of the first circuit board 100, and the external auditory canal (not shown) of the human ear 250 is located on the right side of the second circuit board 210.

In the embodiment, the first circuit board 100 includes a first side E1 and a second side E2 opposite to each other, the second circuit board 210 includes a third side E3 and a fourth side E4 opposite to each other, and the antenna feed wire 132 (as shown in FIG. 2) is disposed on the first side E1 and the third side E3. Such a design allows the antenna signal generated by the antenna layer 130 (as shown in FIG. 2) to be emitted in the direction of the second circuit board 210 (as shown by the arrow) in the form of an electric field through the first circuit board 100, that is, in the direction of the external auditory canal, and thereby the absorption of the antenna signal by the human body can be reduced and the influence on the antenna performance is prevented.

In the embodiment, the first circuit board 100 and the second circuit board 210 are parallel to each other, that is, a distance D1 between the first side E1 and the third side E3 is equal to a distance D2 between the second side E2 and the fourth side E4. When the shortest distance between the first circuit board 100 and the second circuit board 210 is greater than or equal to 2.5 mm, good antenna radiation efficiency and operating bandwidth can be maintained.

Figure 6B:
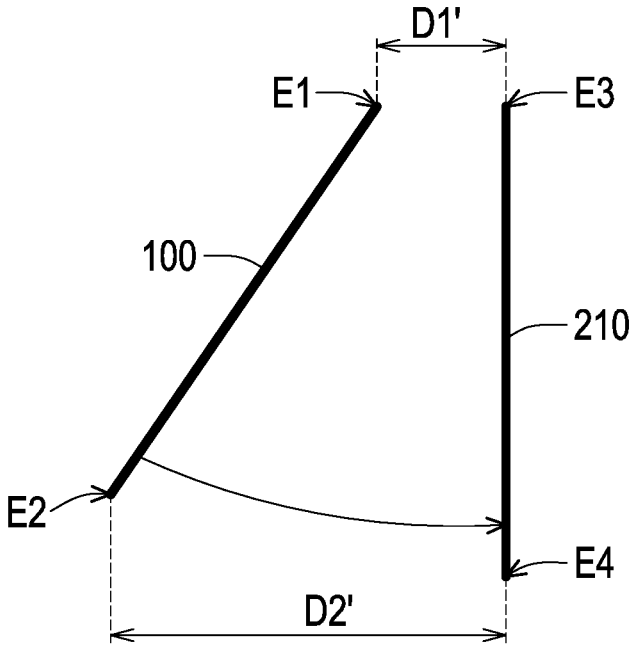
FIG. 6B is a schematic view illustrating another kind of the relative positions of the first circuit board and the second circuit board of the earphone module according to an embodiment of the disclosure.

The first circuit board 100 and the second circuit board 210 are not limited thereto. FIG. 6B is a schematic view illustrating another kind of the relative positions of the first circuit board and the second circuit board of the earphone module according to an embodiment of the disclosure. As shown in FIG. 6B, the first circuit board 100 and the second circuit board 210 may not be parallel to each other. When a distance D2' between the second side E2 and the fourth side E4 is greater than a distance D1' between the first side E1 and the third side E3, the antenna signal generated by the antenna layer 130 (as shown in FIG. 2) may be emitted toward the direction pointed by the arrow through the first circuit board 100 in the form of an electric field, and therefore the radiation energy of the lower hemisphere of the earphone module 10 is favorable, contributing to improving the cross-body performance.

Figure 7A:
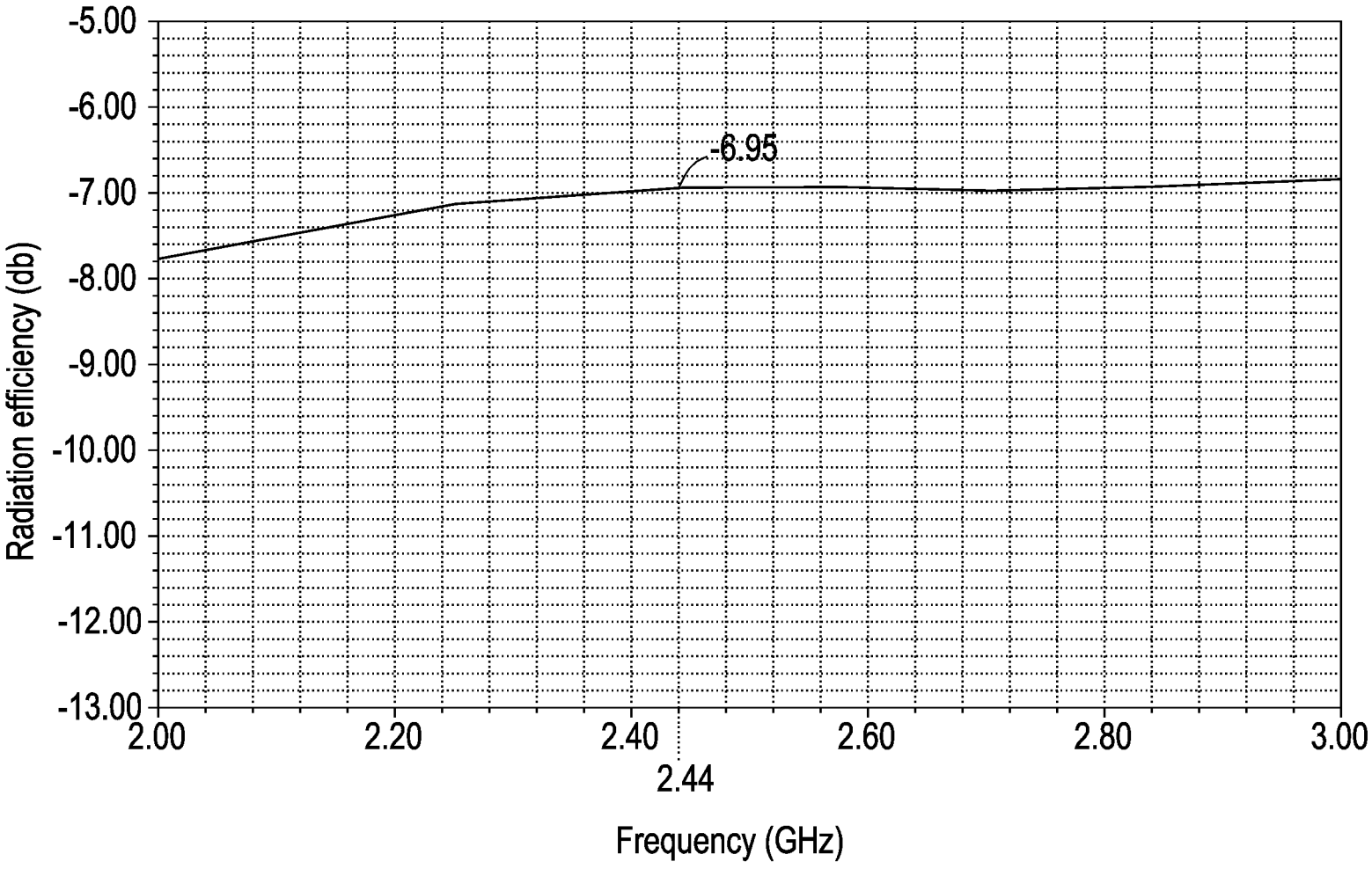
FIG. 7A is a diagram illustrating a relationship between the frequency and the radiation efficiency of the earphone module of FIG. 1.
Figure 7B:
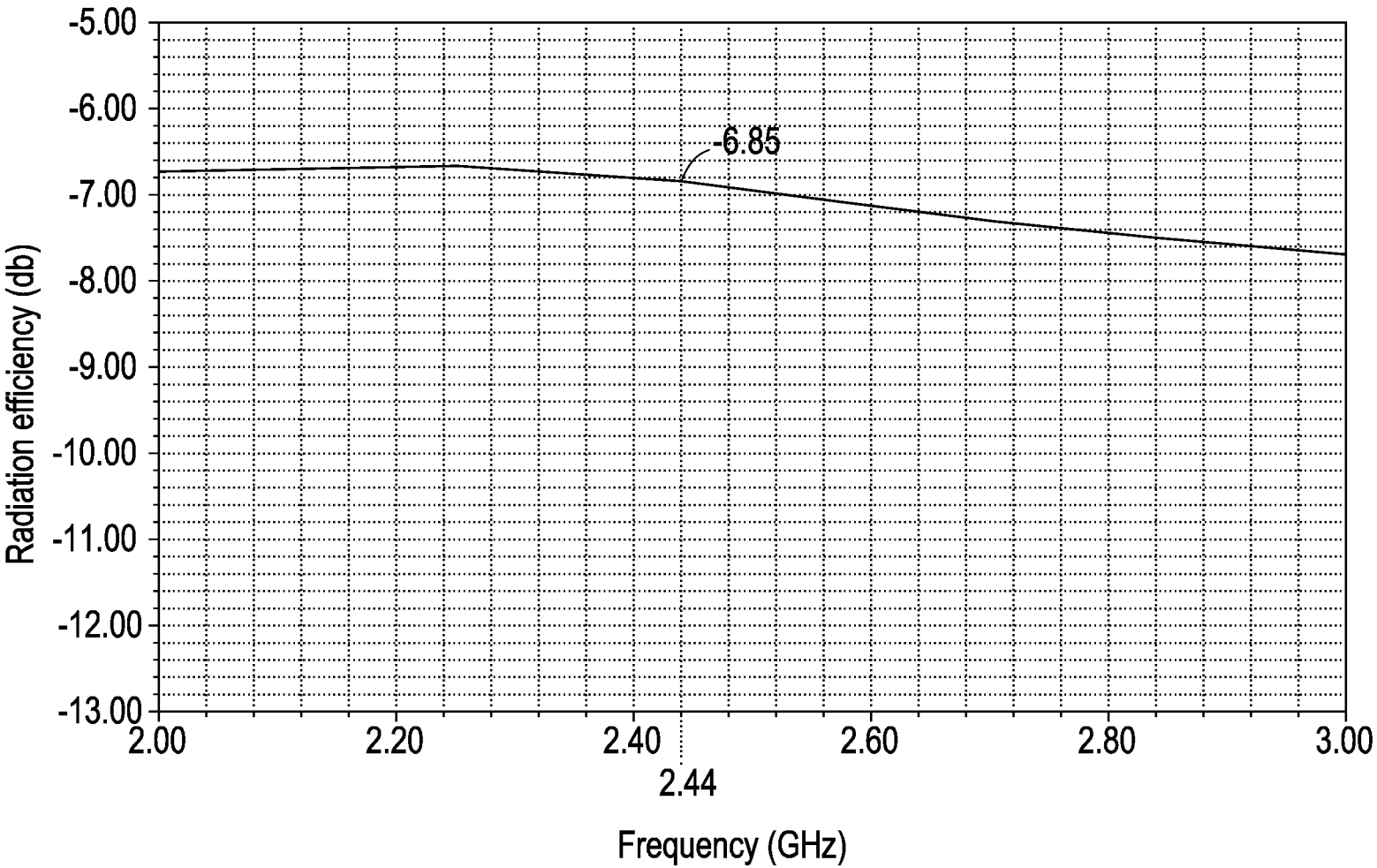
FIG. 7B is a diagram illustrating another relationship between the frequency and the radiation efficiency of the earphone module of FIG. 1.

FIG. 7A is a diagram illustrating a relationship between the frequency and the radiation efficiency of the earphone module of FIG. 1. FIG. 7B is a diagram illustrating another relationship between the frequency and the radiation efficiency of the earphone module of FIG. 1. The difference between FIG. 7A and FIG. 7B is whether the user touches the earphone module 10 by hand (not shown). Specifically, FIG. 7A illustrates a situation when the earphone module 10 is put on the human ear 250, and FIG. 7B illustrates a situation when the earphone module 10 is touched by a hand when the earphone module 10 is put on the human ear 250.

Referring to both FIG. 7A and FIG. 7B, according to actual measurements, in the embodiment, when the earphone module 10 is put on the human ear, the radiation efficiency at the frequency of 2.44 GHz is −6.95 dB, with a favorable difference of 2 dB compared with the radiation efficiency of the related art. Even when the hand of the user touches the earphone module 10, the radiation efficiency of the disclosure only slightly changes to −6.85 dB, that is, the antenna signal is not easily interfered by the human body. In addition, even when the hand of the user touches the earphone module 10, the radiation efficiency of the disclosure also has a favorable difference of 2 dB compared with the radiation efficiency of the related art and has good performance.

In addition, through actual measurements, when the earphone module 10 is turned on, playing music, or playing music along with the turned on touch function, the difference between the antenna receiving ends is less than 1 dB, indicating that the design of the earphone module 10 can maintain a stable signal, resulting in good antenna efficiency.

In summary, the first circuit board of the earphone module of the disclosure includes a touch panel layer, a grounding layer, an antenna layer, and a touch circuit layer assembly. The grounding layer is disposed apart from and below the touch panel layer. The antenna layer includes an antenna flat portion, an antenna feed wire, and an antenna short-circuit wire. The antenna flat portion is disposed apart from and below the grounding layer, and the antenna feed wire and the antenna short-circuit wire are connected to the antenna flat portion. The touch circuit layer assembly is disposed apart from and below the antenna flat portion and includes a touch chip. The touch panel layer is electrically connected to the touch chip. With the multi-layer integration design, the earphone module of the disclosure integrates the touch and antenna structure on the first circuit board without adopting elastic elements to connect between an antenna and a circuit board or between a touch panel and the circuit board, which not only saves the internal space of the earphone but also brings good antenna performance.

What is claimed is:

1. An earphone module, comprising:

a first circuit board, comprising;

a touch panel layer;

a grounding layer disposed apart from and below the touch panel layer;

an antenna layer comprising an antenna flat portion, an antenna feed wire, and an antenna short-circuit wire, wherein the antenna flat portion is disposed apart from and below the grounding layer, and the antenna feed wire and the antenna short-circuit wire are connected to the antenna flat portion; and a touch circuit layer assembly disposed apart from and below the antenna flat portion and comprising a touch chip, wherein the touch panel layer is electrically connected to the touch chip.

2. The earphone module according to claim 1, wherein the touch circuit layer assembly further comprises a touch wire assembly disposed apart from and below the antenna short-circuit wire, and a width of the antenna short-circuit wire is greater than or equal to a width of the touch wire assembly.

3. The earphone module according to claim 2, wherein the touch circuit layer assembly further comprises a ground wire located beside the touch wire assembly, and the ground wire is located between the touch wire assembly and a projection of the antenna feed wire on a surface where the touch wire assembly is located.

4. The earphone module according to claim 1, wherein the touch circuit layer assembly further comprises a first touch circuit layer, a second touch circuit layer, and a third touch circuit layer; the first touch circuit layer is disposed apart from and below the antenna flat portion; the second touch circuit layer is disposed apart from and below the first touch circuit layer; the third touch circuit layer is disposed apart from and below the second touch circuit layer; and the touch chip is located on the third touch circuit layer.

5. The earphone module according to claim 4, wherein the antenna flat portion, the first touch circuit layer, the second touch circuit layer, and the third touch circuit layer are connected to the grounding layer through a plurality of ground through holes.

6. The earphone module according to claim 1, wherein the touch panel layer is connected to the touch circuit layer assembly through the grounding layer and a plurality of touch through holes on the antenna flat portion and electrically connected to the touch chip.

7. The earphone module according to claim 6, wherein the touch panel layer comprises a plurality of blocks electrically separated from each other, and the blocks are connected to the touch circuit layer assembly through the touch through holes, respectively.

8. The earphone module according to claim 1, further comprising a microphone, wherein the first circuit board comprises a notch corresponding to the microphone, and a projection of the microphone on the first circuit board is located within the notch.

9. The earphone module according to claim 8, further comprising a second circuit board disposed below the first circuit board, wherein a resonance path is the antenna feed wire from the second circuit board along an edge of the first circuit board to a portion beside the notch, the resonance path is coupled out a frequency band, and the length of the resonance path is 0.25 times a wavelength of the frequency band.

10. The earphone module according to claim 9, wherein when the earphone module is placed in a human ear, the antenna feed wire is close to an inferior crus of the antihelix of the human ear and away from an earlobe, and the resonance path extends along a direction of a tragus and an antitragus from the inferior crus of the antihelix.

11. The earphone module according to claim 1, further comprising a second circuit board disposed below the first circuit board, wherein the antenna feed wire and the antenna short-circuit wire are connected to the second circuit board, and a shortest distance between the first circuit board and the second circuit board is greater than or equal to 2.5 mm.

12. The earphone module according to claim 1, further comprising a second circuit board disposed below the first circuit board, wherein the first circuit board comprises a first side and a second side opposite to each other, the second circuit board comprises a third side and a fourth side opposite to each other, the antenna feed wire is disposed on the first side of the first circuit board and the third side of the second circuit board, and a distance between the second side and the fourth side is greater than or equal to a distance between the first side and the third side.

13. The earphone module according to claim 11, wherein when the earphone module is placed in a human ear, the second circuit board is located between the first circuit board and an external auditory canal of the human ear, so that the antenna layer generates an antenna polarization direction that enters the external auditory canal.

* * * * *